US006467205B1

(12) United States Patent
Flagg et al.

(10) Patent No.: US 6,467,205 B1
(45) Date of Patent: Oct. 22, 2002

(54) CALENDAR CUBE APPARATUS

(76) Inventors: Cristopher Hastings Flagg, 13958 Lightburn La., Centerville, VA (US) 20121; Timothy D. Flagg, 7411 Gary St., Springfield, VA (US) 22150

( * ) Notice: Subject to any disclaimer, the term of this patent is extended or adjusted under 35 U.S.C. 154(b) by 33 days.

(21) Appl. No.: 09/708,414

(22) Filed: Nov. 9, 2000

(51) Int. Cl.[7] ..... G09D 3/00
(52) U.S. Cl. ..... 40/107; 283/2; 273/157 R
(58) Field of Search ..... 40/107, 111, 119; 283/2; D19/20; 273/155, 157 R

(56) References Cited

U.S. PATENT DOCUMENTS 3,596,396 A * 8/1971 Thomson ..... 273/155 X
4,409,750 A * 10/1983 Silbermintz ..... 40/107
4,875,681 A * 10/1989 Ofir ..... 273/155
5,192,077 A * 3/1993 Caicedo ..... 273/155
5,538,288 A * 7/1996 Heath ..... 40/107 X
6,106,017 A * 8/2000 Johnson ..... 40/107 X
6,264,199 B1 * 7/2001 Schaedel ..... 273/157 R

* cited by examiner

*Primary Examiner*—Brian K. Green

(57) ABSTRACT

A calendar cube is made of eight individual cubes, each cube having six equal cube sides. Single pliable sheet material covers selected individual cube sides. Double pliable sheet material covers selected adjacent cube sides, forming a hinge portion oriented therebetween. Twelve individual cube faces are provided by a first set of six cube faces and a second set of six cube faces. Each month of the year is selectively positioned upon a selected one of the twelve cube faces, so that the user may selectively display a monthly calendar and advertising indicia thereon, which provides the current month and date. Manipulation of selected cubes, positions the current month on the top face of the cube. This is a challenge which changes month to month, and provides entertainment to the user of the calendar cube apparatus.

21 Claims, 8 Drawing Sheets

CALENDAR CUBE APPARATUS

BACKGROUND OF THE INVENTION

Cubes have been used for advertising on many occasions. A cube typically has six sides, a front side, a backside, a left side, a right side, a top side and a bottom side.

One such cube is formed with layer upon layer of paper, until the length, width and height of the cube is substantially equal in size. The outer edges of the paper on four sides have indicia, such as advertising thereon. As each paper is used, the cube shrinks in height and the indicia disappears as the paper is used.

Cubes have been divided in a manner to require manipulation to accomplish the desired results. One such cube is the popular Rubic's Cube puzzle, which divides each of the six sides of the cube into three rows and columns, to provide 9 colored square segments on each of the six exposed sides. The segments may be rotated to align similar colors together to solve the puzzle.

Transparent cubes have been used to imbed an object within the cube. These cubes are at times used as a paperweight or other decorative object.

A search of the U.S. patent files was made to locate relevant prior art. The following prior art patents were noted of interest. No prior art patent was found that was believed to disclose or make obvious, applicant's novel calendar cube apparatus.

U.S. Pat. No. 3,596,396 issuing to Betty Thomson on Aug. 3, 1971, discloses a system of hinging distinct similar polygonic shapes, whereby the shapes may be pivoted individually or in groups, independent of the remainder of the shapes.

U.S. Pat. No. 4,875,681 issuing Oct. 24, 1989 to Arie Offir, discloses hingedly connected cubical prisms, wherein individual cubical prisms are independently hinged.

U.S. Pat. No. 5,192,077 issuing to Oswald Calcedo on Mar. 9, 1993, discloses a polyhedron having indicia representative of numbers and fractions thereon.

U.S. Pat. No. 3,628,261 issuing to Robert Thompson on Dec. 21, 1971, discloses multiple cubes utilizing first and second hinge strips allowing manipulation of individual cubes.

U.S. Pat. No. 3,924,376 issuing to Sukeo Tsurumi on Dec. 9, 1975, discloses six face plates, each having a calendar month displayed on each side of the six face plates. The face plates are joined together to form a cube displaying six calendar months. The faceplates must be removed from the cube, and reassembled to form a new cube to display the remaining six months. The face plates may be made of wood to form packing crates, or made of concrete to form building blocks.

U.S. Pat. No. 4,409,750 issuing to Marvin Silbermintz on Oct. 18, 1983 discloses a calender formed from a cube puzzle having 54 cubies, which are manipulated to display the date, month and the name of any day in a year.

U.S. Pat. No. 3,487,578 issuing to J. Sudermann on Jan. 6, 1970, discloses an array of 16 blocks joined by double-acting hinge means in rows and columns to display various shapes and images.

U.S. Pat. No. 3,222,072 issuing to A. Dreyer on Dec. 7, 1965 discloses 27 cubes connected by an elastic member extending through an aperture in each cube.

U.S. Pat. No. 3,670,436 issuing to J. Weissman on Jun. 20, 1972, discloses a cube calendar formed of four cubes supported by a holder, to display the month, date and day.

U.S. Pat. No. 3,826,029 issuing to J. Lieberman on Jul. 30, 1974 discloses a single cube which is sequentially unfolded to display the current date and advertising.

U.S. Pat. No. 5,538,288 discloses a parallelogram sheet for forming a reversible parallelepiped with multi-folding sides.

U.S. Pat. No. 6,116,071 issuing to G. Popat, G. Ray and R. Pollman on Sep. 12, 2000 discloses a method for custom printing and forming three-dimensional structures such as a four sided pyramid or a 14 sided calendar.

U.S. Pat. No. 3,655,201 issuing to L. Nichols on Apr. 11, 1972 discloses a pattern forming puzzle having eight cubes which are magnetically engaged.

SUMMARY OF THE INVENTION

Eight individual cubes, each cube having six equal sides, are manipulated to form a calendar cube. The calendar cube has a first set of six cube faces, and a second set six cube faces. Each cube face is made up of four cube sides. The eight individual cubes are selectively manipulated to position each of the twelve cube faces upon the top portion of the cube. Each monthly calendar is placed upon one of the selected cube faces of the calendar cube, so that the user may selectively display a monthly calendar, which provides the current month and date. Manipulation of the calendar cube to position the current month on the top portion of the cube is a challenge which changes month to month, and provides entertainment to the user of the calendar cube. Advertising indicia is placed upon each of the twelve cube faces, to promote a company, product or service. This novel calendar cube is likely to remain on the user's desk for the duration of the year, and may be adjusted to display different calendar indicia for each month of the year as well as presenting advertising indicia upon each exposed cube face of the calendar cube.

Each of the eight individual cubes has a substantially equal length, width and depth. Indicia is printed, screened or otherwise marked upon a pliable sheet material, which is secured to selected individual cube sides. Pliable sheet material with selected indicia thereon, is also secured to selected side-by-side cube sides, forming a hinge portion between adjacent cube sides. The pliable sheet material may be in the form of a paper, plastic, fabric, cloth or other pliable sheet material. The eight individual cubes are selectively manipulated to bend the hinge portion up to 180 degrees. This allows the eight cubes to be selectively positioned to form a total of twelve cube faces, with each cube face comprising four cube sides, with a selected cube face manipulated into a top face of the calendar cube. Each of the twelve calendar cube faces includes a monthly calendar and advertising thereon, which is selectively manipulated by moving adjacent cubes about their respective hinge portions.

Figure 2:
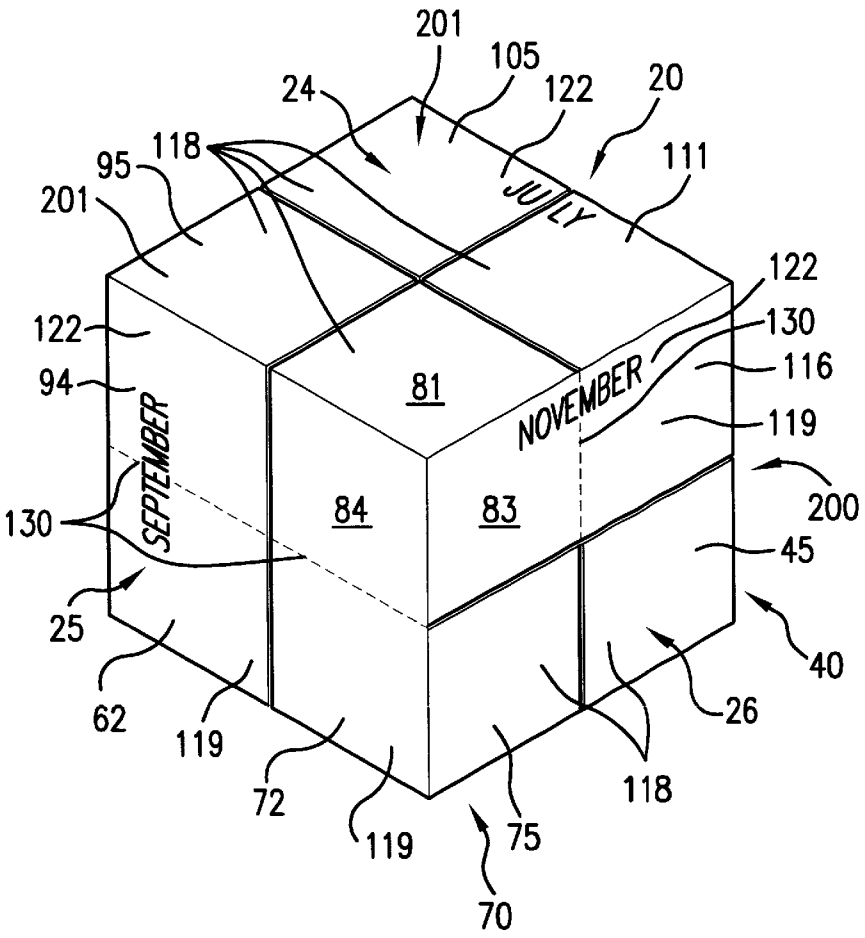
FIG. 2 is a perspective view of the calendar cube turned and rotated to show the remaining three calendar cube faces in the first set of calendar cube faces.

Thus one object is to provide eight individual, equally sized cubes, which are selectively joined by multiple single and double sized pliable sheet material having indicia thereon, and selectively manipulated to display twelve monthly calendar cube faces.

Another object is to provide advertising indicia on at least some of the twelve calendar cube faces.

Yet another object is to provide a combination monthly calendar which is selectively manipulated each month about selective hinge portions, to select the appropriate monthly calendar for viewing.

These objects and advantages will be best understood in reference to the drawings and specification filed herewith.

DETAILED DESCRIPTION OF THE INVENTION

As shown in FIG. 1 through FIG. 10, the calendar cube apparatus 200 comprises eight equally sized individual cubes 38, which together form a first set of six cube faces 20, each made of four individual cube sides. The eight individual cubes 38 are further manipulated to form a second set of six cube faces 30, each cube face 30 made of four cube sides. Thus, a total of twelve individual cube faces 20, 30 are selectively manipulated to bring a selected one of the twelve cube faces 21–26 and 31–36 into view upon the top face 201 of the calendar cube apparatus 200. Twelve individual monthly calendar indicia 122 are secured to a selected one of the twelve cube faces, 21–26 and 31–36. Each calendar indicia 122 is representative of one of the twelve months 132 of a given year 134.

Figure 12:
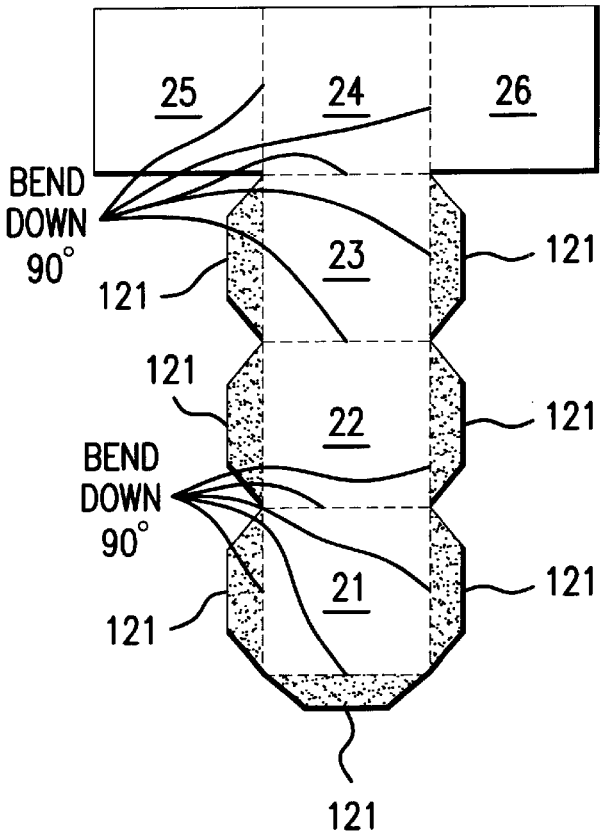
FIG. 12 is a plan view of a sheet material with tabs and score lines to cut and fold the sheet material to form a hollow cube having six equal sides.
Figure 13:
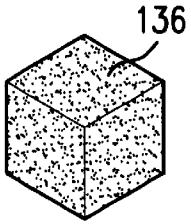
FIG. 13 is a perspective view of a solid cube having six equal sides.
Figure 16B:
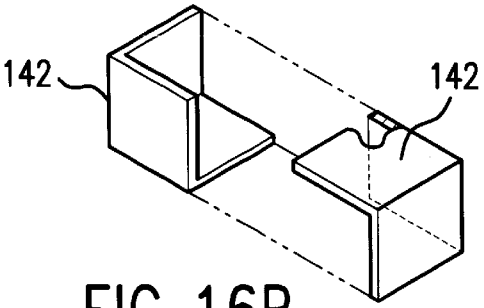
FIG. 16B is an alternate exploded view of two three-sided pieces, which may be joined together to form a six sided hollow cube.

The eight equally sized cubes 38, each comprise a cube having six equally sized cube sides. Each cube 38 may be of solid construction as shown in FIG. 13, or of hollow construction, as shown in FIG. 12, and FIG. 14 through FIG. 18.

For example, the first cube 40 includes cube side 41, cube side 42, cube side 43, cube side 44, cube side 45, and cube side 46. The second cube 50 includes cube side 51, cube side 52, cube side 53, cube side 54, cube side 55, and cube side 56. The third cube 60 includes cube side 61, cube side 62, cube side 63, cube side 64, cube side 65, and cube side 66. The fourth cube 70 includes cube side 71, cube side 72, cube side 73, cube side 74, cube side 75, and cube side 76. The fifth cube 80 includes cube side 81, cube side 82, cube side 83, cube side 84, cube side 85, and cube side 86. The sixth cube 90 includes cube side 91, cube side 92, cube side 93, cube side 94, cube side 95, and cube side 96. The seventh cube 100 includes cube side 101, cube side 102, cube side 103, cube side 104, cube side 105, and cube side 106. The eighth cube 110 includes cube side 111, cube side 112, cube side 113, cube side 114, cube side 115, and cube side 116.

Each of the eight equally sized cube portions 38 are covered with a pliable sheet material 120 which is selected to be either a single sized 118 pliable sheet material 120 which is sized to cover a single cube side, or a double sized 119 pliable sheet material, which is sized to cover two adjacent cube sides. The pliable sheet material 120 is preferably secured to a selected cube side with a suitable adhesive or glue. The double sized 119 cube portion comprises one cube portion in width by two cube portions in length. The double sized 119 pliable sheet material 120 is secured to two adjacent cube sides, forming a hinged portion 130 therebetween. In FIG. 1 through FIG. 10, each of the hinged portions 140 are shown in dashed line.

Figure 1:
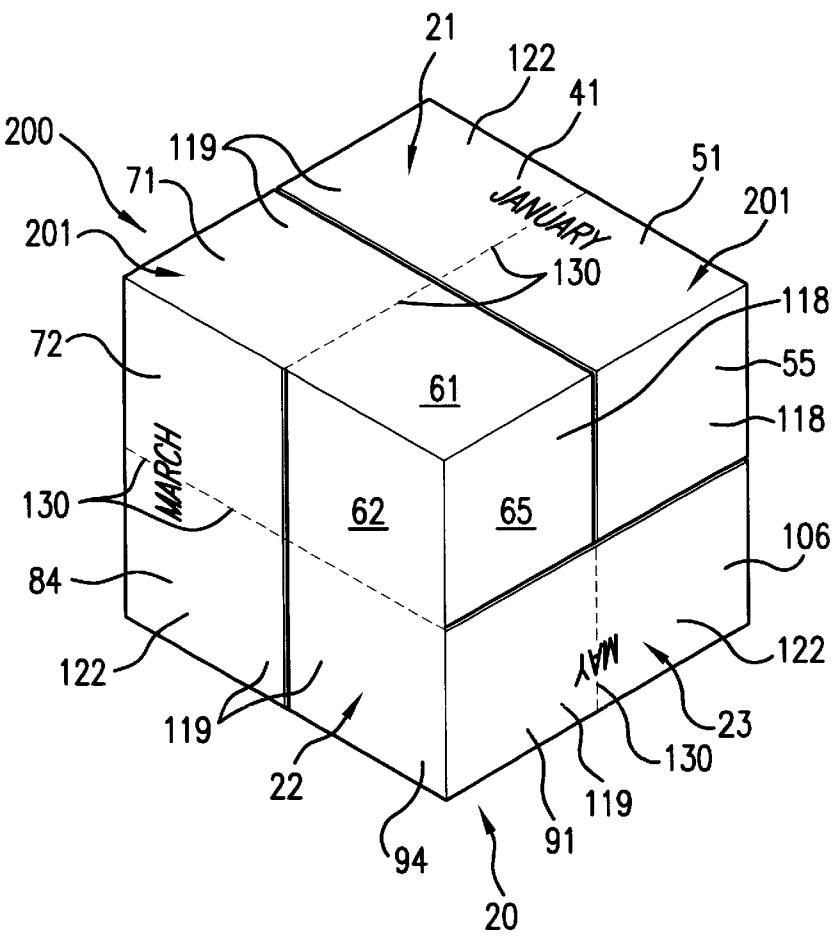
FIG. 1 is a perspective view of the calendar cube showing three of the first set of six calendar cube faces.

As shown in FIG. 1, a first set of six cube faces, comprises a first cube face 21 which is formed with cube side 41 and cube side 51 joined together by a double sized 119 pliable sheet material 120, forming a hinge portion therebetween. Cube side 61 and cube side 71 are also joined together with a double sized 119 pliable sheet material 120, forming a hinge portion 130 therebetween. Each of the double sized pliable sheet material 120 forms one-half of the first cube face 21. The first cube face 21 shown in FIG. 1 preferably contains calendar indicia 122 representative of the calendar month January.

The second cube face 22 is formed with cube side 62 and cube side 94 joined together with a double sized 119 pliable sheet material 120, forming a hinge portion 130 therebetween. Cube side 72 and cube side 84 are also joined together with a double sized 119 pliable sheet material 120, forming a hinge portion therebetween. Thus, the second cube face is formed with two double sized 119 pliable sheet material, which each double sized 119 pliable sheet material 120 forming one-half of the second cube face 22. The second cube face 22 shown in FIG. 1 preferably contains calendar indicia 122 representative of the calendar month March.

The third cube face 23 is formed with a cube side 55 having a single sized 118 pliable sheet material 120, and with cube side 65 also having a single sized 118 pliable sheet material 120. Each of the single sized 118 pliable sheet material 120 forms one quarter of the third cube face 23. Cube side 91 and cube side 106 are joined together with a double sized 119 pliable sheet material 120, forming a hinge portion 130 therebetween. Thus, two single sized 118 and one double sized 119 pliable sheet material form the third cube face 23. The third cube face 23 shown in FIG. 1 preferably contains calendar indicia 122 representative of the calendar month May.

As shown in FIG. 2, the first set of six cube faces 20 are turned and rotated to show the fourth, fifth and six cube faces 24, 25, 26. The fourth cube face 24 is formed with a single sized cube side 81, a single sized cube side 95, a single sized cube side 105, and a single sized cube side 111. Thus, all four single sized 118 cube sides form the fourth cube face 24. The fourth cube face 24 shown in FIG. 2 preferably contains calendar indicia 122 representative of the calendar month July.

The fifth cube face 25 is formed with cube side 72 and cube side 84 joined together with a double sized 119 pliable sheet material 120, forming a hinged portion 130 therebetween. Cube side 62 and cube side 94 are also joined together with a double sized 119 pliable sheet material 120, forming a hinge portion 130 therebetween. Each of the double sized 119 pliable sheet material 120 forms one half of the fifth cube face 25. The fifth cube face 25 shown in FIG. 2 preferably contains calendar indicia 122 representative of the calendar month September.

The sixth cube face 26 comprises a single sized cube side 45, and a single sized cube side 75. Each single sized cube side is 45, 75 is covered with a single sized pliable sheet material 118, each forming one quarter of the sixth cube face 26. Cube side 116 and cube side 83 are joined together with a double sized 119 pliable sheet material 120, forming a hinge portion 130 therebetween. The double sized 119 pliable sheet material covers one-half of the sixth cube face 26. The sixth cube face 26 shown in FIG. 2 preferably contains calendar indicia 122 representative of the calendar month November.

Figure 3A:
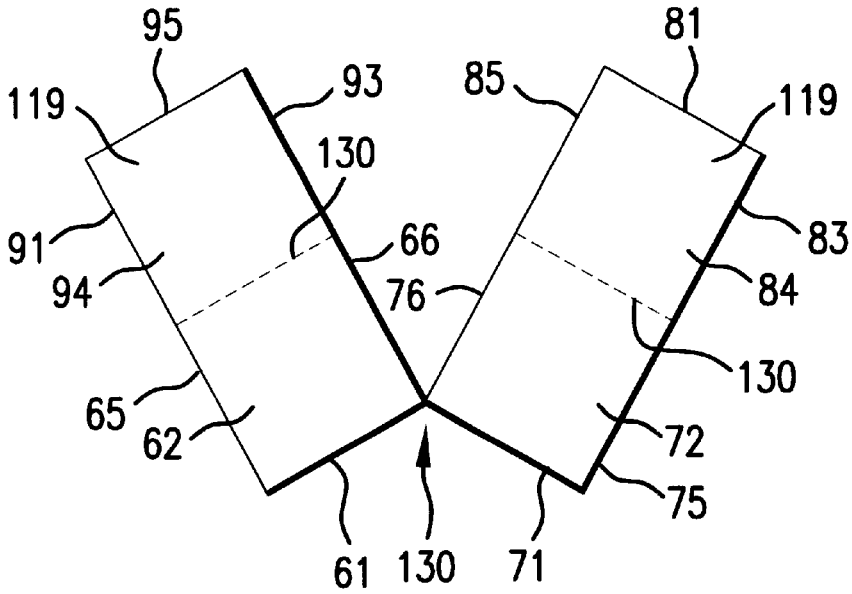
FIG. 3A is an end view of the calendar cube face showing two calendar cube sides partially hinged about the bottom portion of the calendar cube apparatus.
Figure 3B:
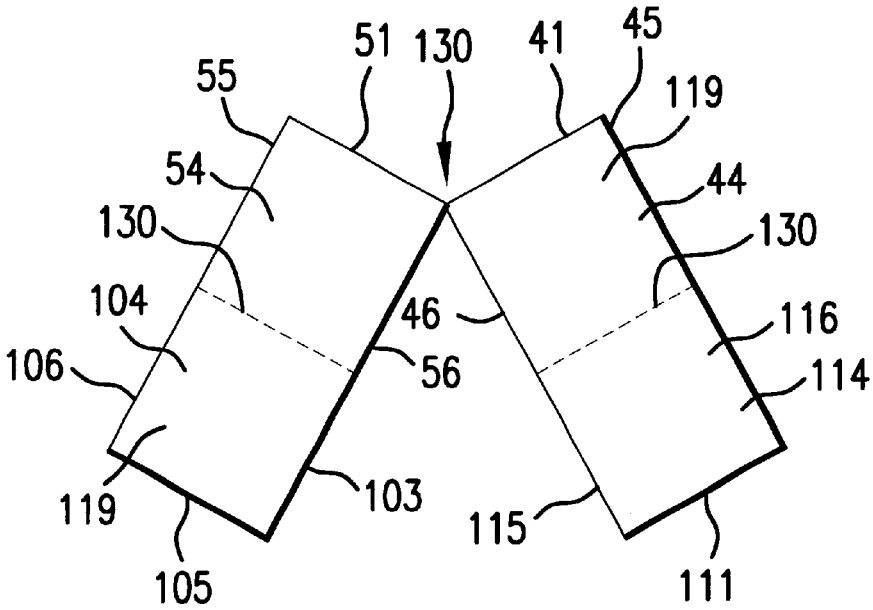
FIG. 3B is an alternate end view of the calendar cube showing two different calendar cube halves partially hinged about the top portion of the calendar cube apparatus.
Figure 4A:
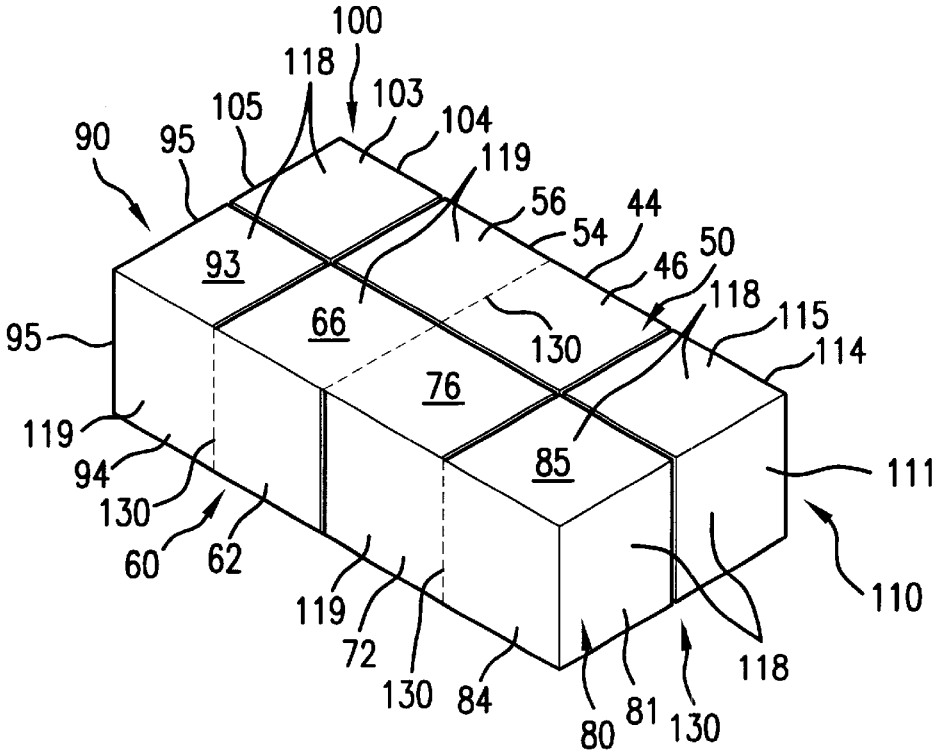
FIG. 4A is a perspective view of two calendar cube faces, positioned in side-byside relation, which displays all eight calendar cubes, which was formed by closing the hinged portion shown in FIG. 3A.
Figure 4B:
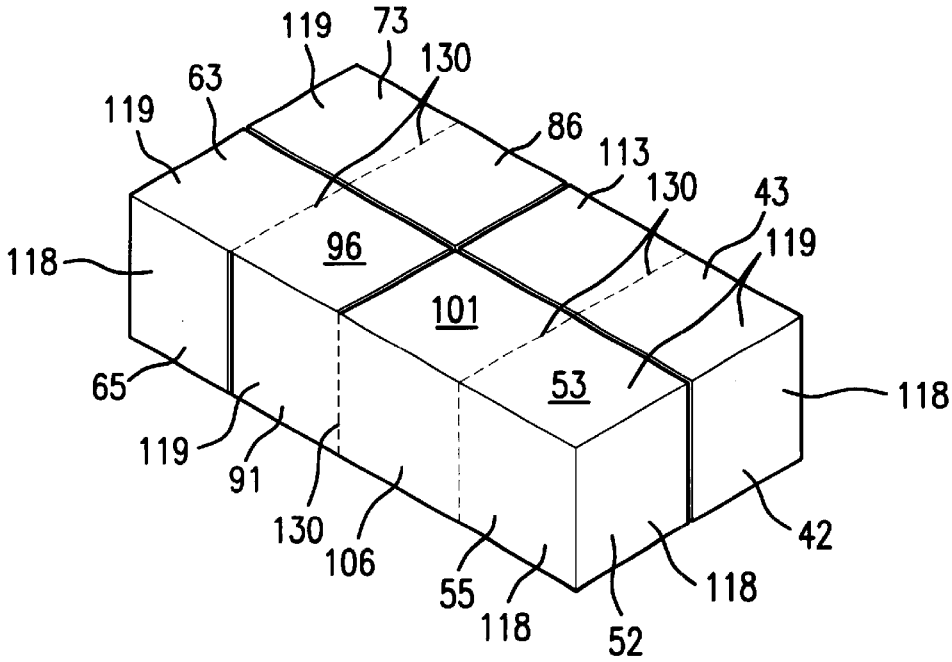
FIG. 4B is an alternate perspective view of the calendar cube faces shown in FIG. 4A.

In order to expose the second set of six cube faces 30, the eight individual cubes must be selectively manipulated. For example, the second cube face 22 may be partially pivoted about hinge portion 130, as shown in FIGS. 3A and 3B. The opposing sides of the second cube face 22 are then fully pivoted about hinge portions 130, as shown in FIG. 4A. In this position, all eight equal cube portions 38 are clearly shown in side by side relation.

Figure 5A:
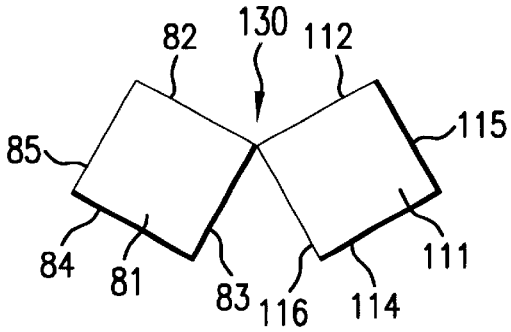
FIG. 5A is an end view of two individual cubes, shown on the right side of FIG. 6, which are partially pivoted about respective hinge portions.
Figure 5B:
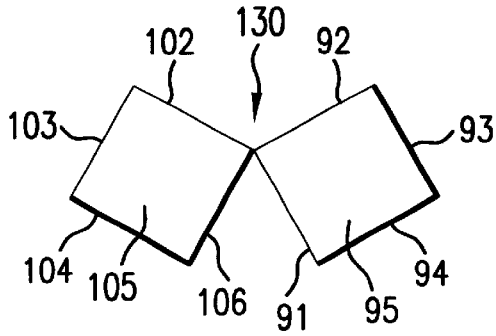
FIG. 5B is an alternate end view of two individual cubes, which are also partially pivoted about respective hinge portions.
Figure 6:
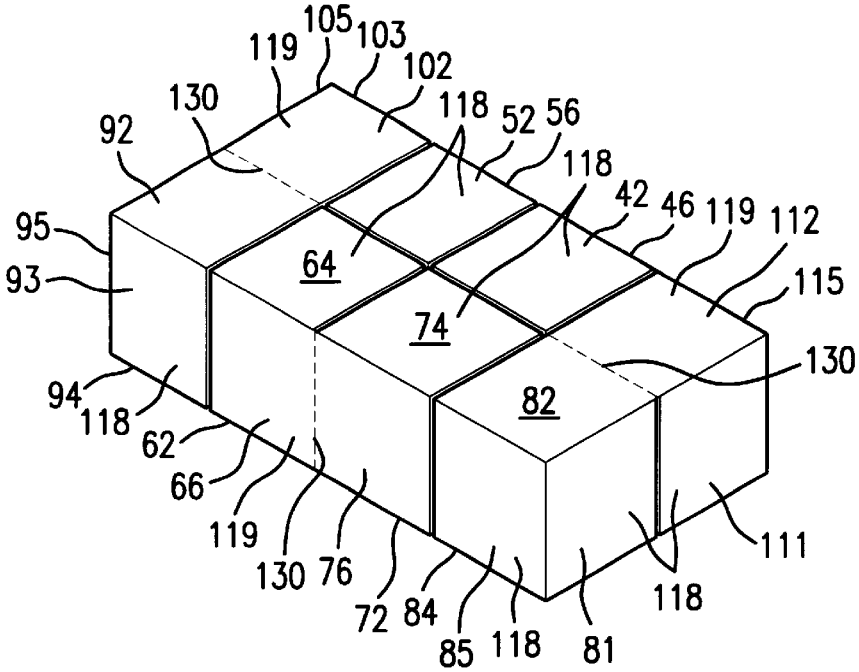
FIG. 6 is a perspective view of two additional calendar cube faces positioned in side-by-side relation, which was formed by closing the hinged portion shown in FIG. 5A.
Figure 7A:
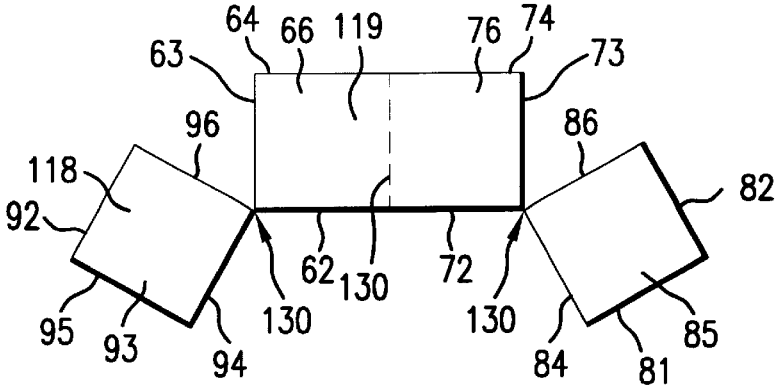
FIG. 7A is an end view of four cube sides, with two cube portions joined by a double pliable sheet material, and with two individual cube portions partially pivoted about respective hinge portions.
Figure 7B:
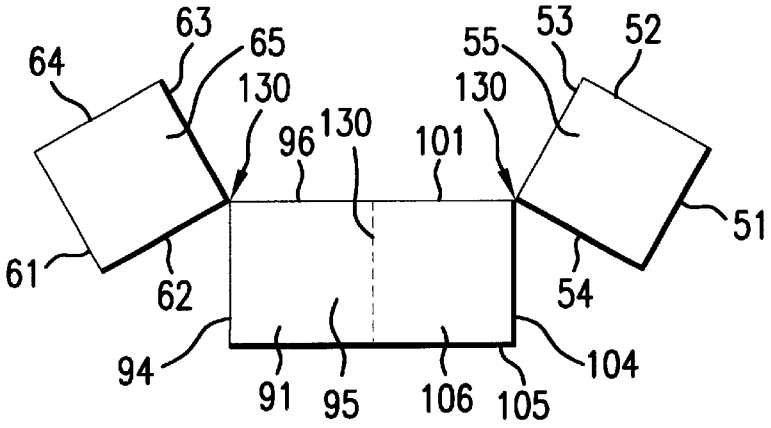
FIG. 7B is an alternate end view of four cube sides, with two cube sides joined by a double pliable sheet material, and with two individual cube portions partially pivoted about respective hinge portions.

The eight cube portions 38 are then manipulated to be partially pivoted as shown in end view in FIG. 5A. When fully pivoted, the eight cube portions 38 are positioned as shown in FIG. 6. The outer cubes 115 and 103 may then be partially pivoted about hinge portions 130 as shown in FIG. 7A.

Figure 8:
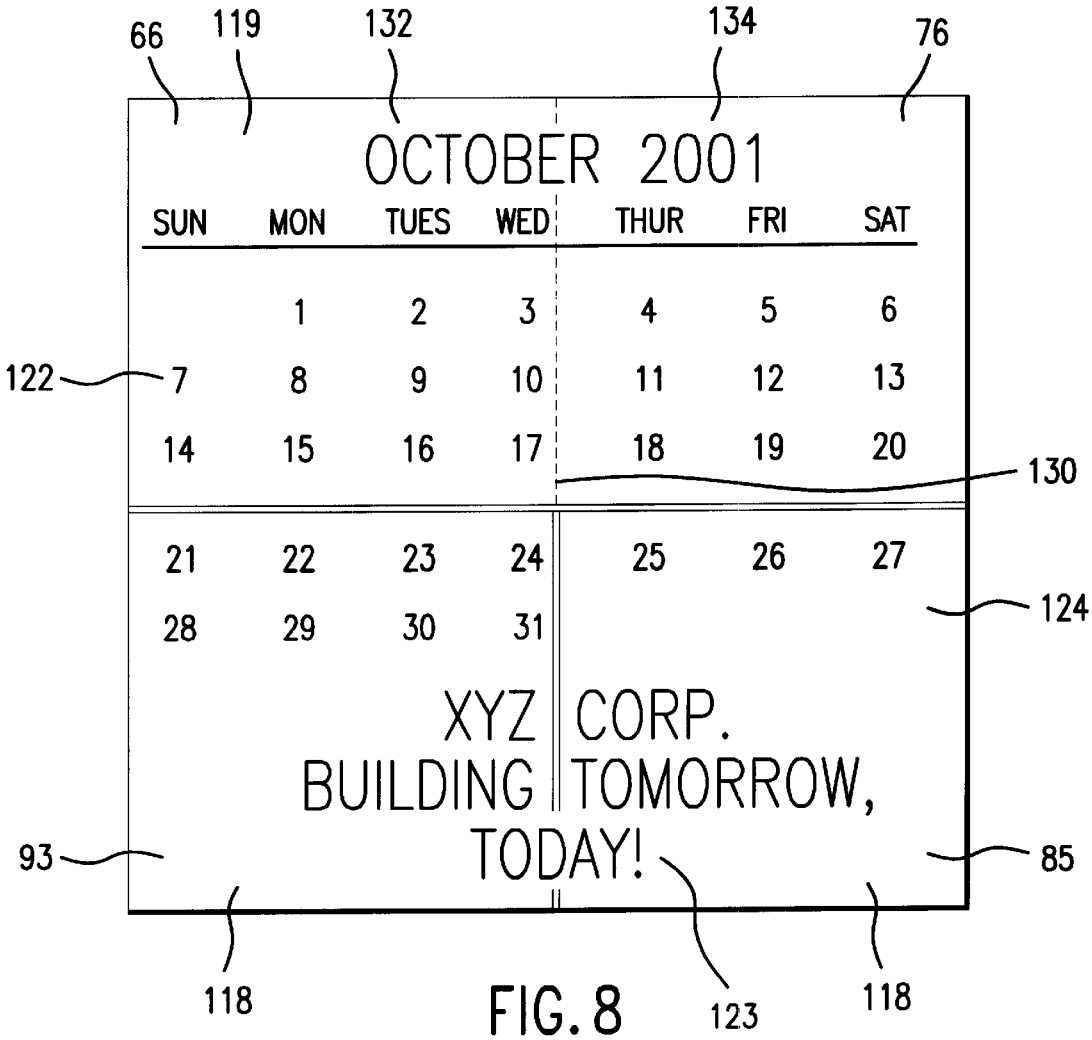
FIG. 8 is an end view of four individual cube sides closed together about respective hinge portions to form a selected calendar face with calendar indicia and advertising indicia positioned thereon.
Figure 11:
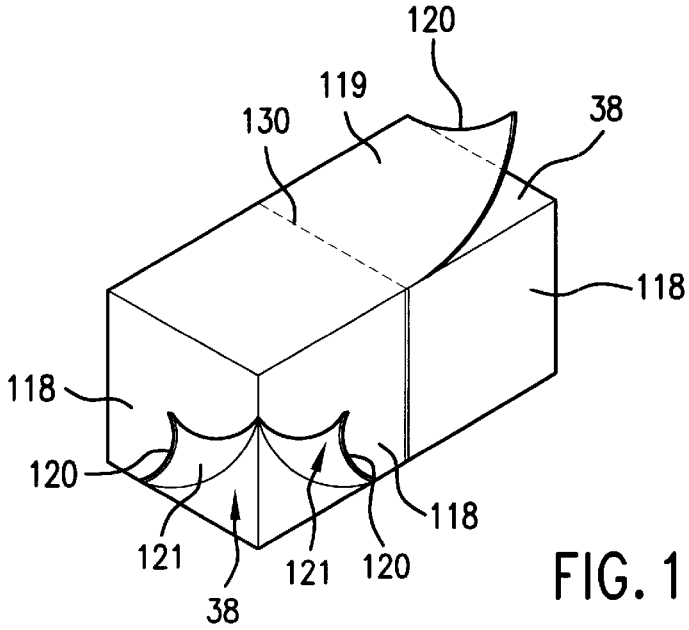
FIG. 11 is a perspective view showing the pliable sheet material adhesively secured to two adjacent cube sides.
Figure 10:
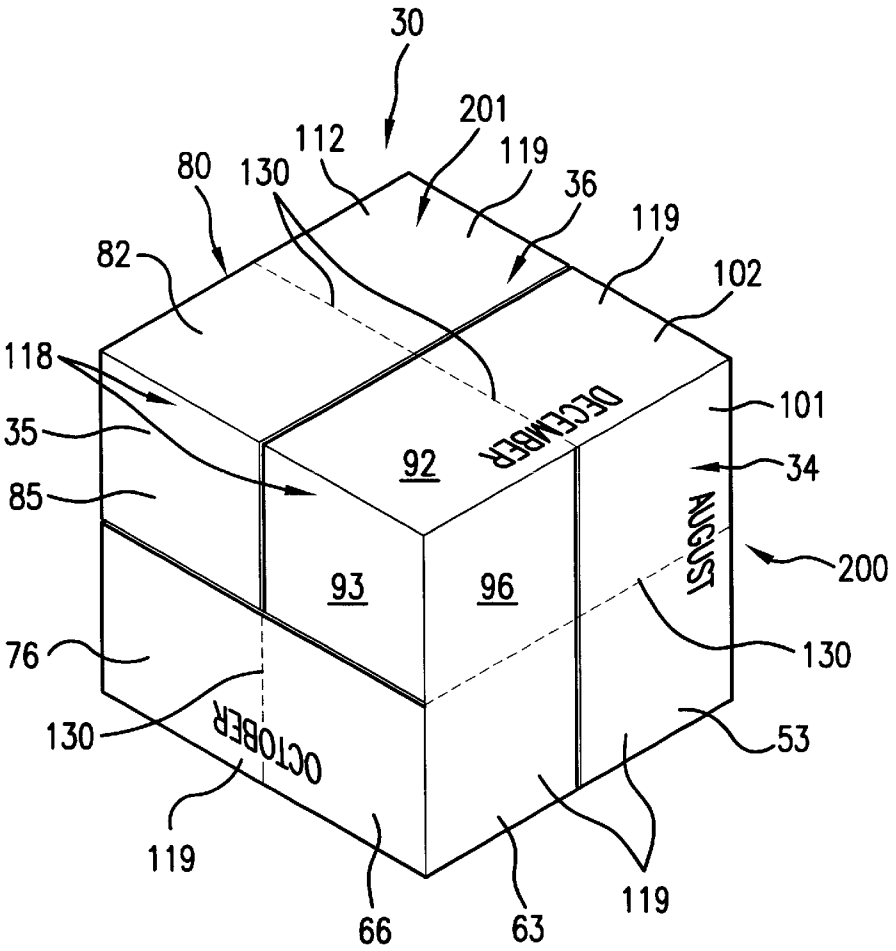
FIG. 10 is a perspective view of the calendar cube of FIG. 9, showing the remaining three calendar cube faces of the second set of six calendar cube faces.
Figure 9:
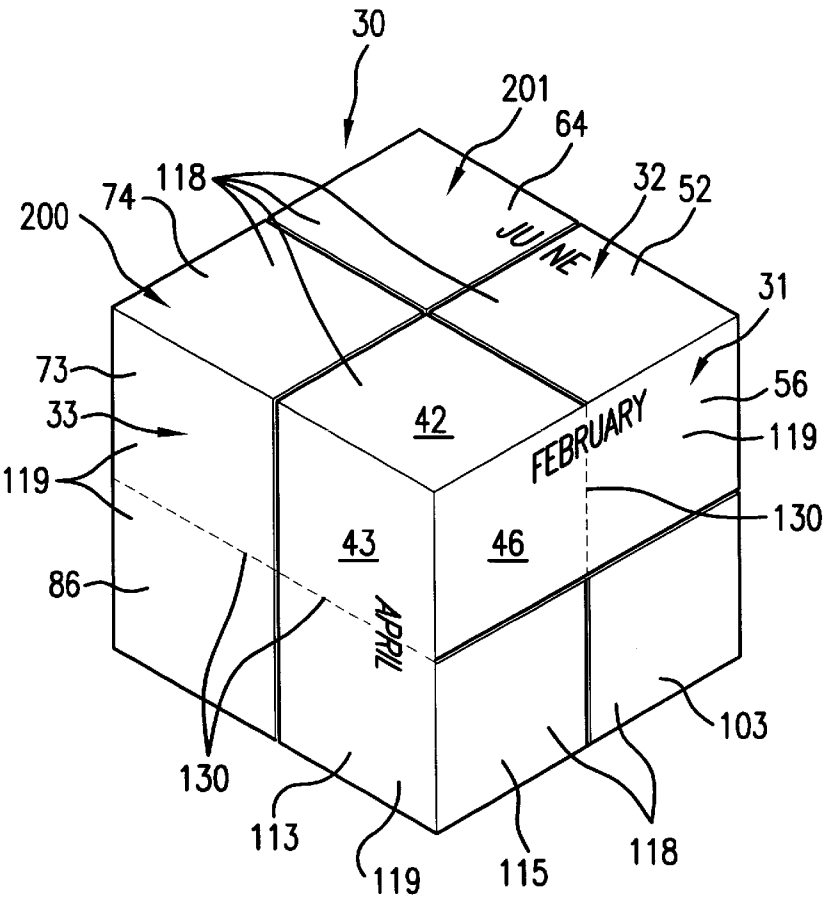
FIG. 9 is a perspective view showing three cube faces of the second set of six calendar cube faces.
Figure 15:
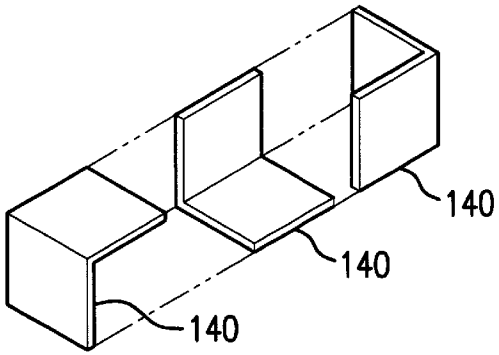
FIG. 15 is an exploded view of three two-sided pieces, which may be joined together to form a six sided hollow cube.
Figure 18:
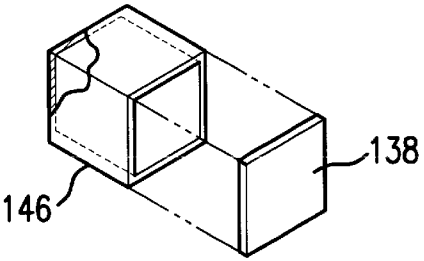
FIG. 18 is an exploded view of a four sided tube having one closed end, which may be joined together with one independent end piece to form a six sided hollow cube.
Figure 14:
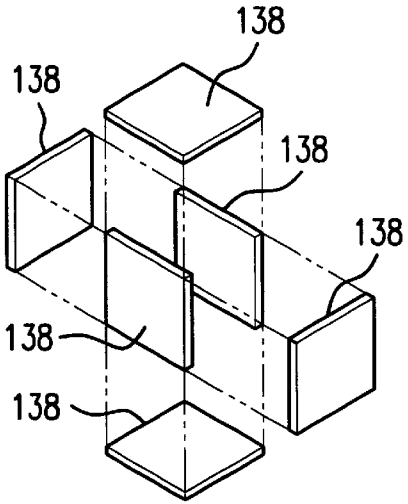
FIG. 14 is an exploded view of six individual sides, which may be joined together to form a six sided hollow cube.
Figure 17:
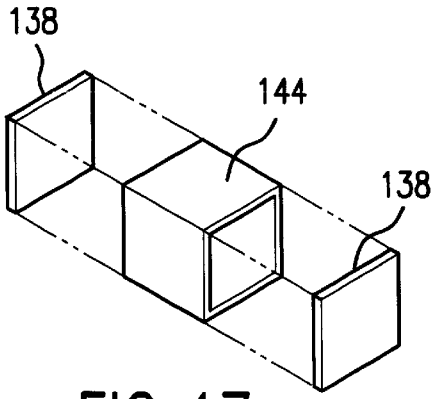
FIG. 17 is an exploded view of a four-sided, open ended tube, which may be joined together with two independent end pieces to form a six sided hollow cube.
Figure 16A:
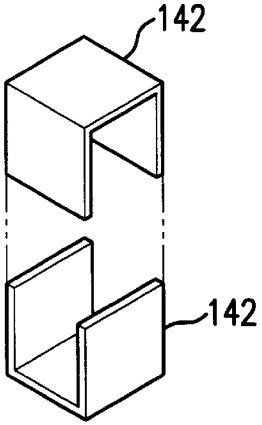
FIG. 16A is an exploded view of two three-sided pieces, which may be joined together to form a six sided, hollow cube.

When fully pivoted, as shown in FIG. 8, cube sides 46 and 56 are joined with a double sized pliable sheet material 119, forming a hinge portion 130 therebetween. Single cube sides 103 and 115 are each covered with a single sized 118 pliable sheet material 120. The double sized 119 pliable sheet material 120 and two single sized 118 pliable sheet materials 120 together form the seventh cube face 31. The seventh cube face 31 is also shown in FIG. 10, and preferably contains calendar indicia 122 representative of the calendar month October.

When viewed in perspective, the second set of six cube sides 30 are now selectively manipulated to be visible. When manipulated as shown in perspective view in FIG. 9, the seventh cube face 31, eighth cube face 32 and ninth cube face 33 are now visible.

The eighth cube face 32 comprises four single cube faces, 42, 52, 64 and 74.

Each of these single cube faces is covered with a single pliable sheet material 118, forming the eighth cube face 32. The eighth cube face 32 shown in FIG. 9, preferably contains calendar indicia 122 representative of the calendar month April.

The ninth cube face 33 comprises four cube faces 43, 73, 86 and 113. Cube faces 73 and 86 are joined together by a double sized 119 pliable sheet material 120, forming a hinge portion 130 therebetween. Likewise, cube faces 43, and 113 are joined together by a double sized 119 pliable sheet material 120, forming a hinge portion 130 therebetween. Each of the double sized 119 pliable sheet material 120 forms the ninth cube face 33. The ninth cube face 33 shown in FIG. 9, preferably contains calendar indicia 122 representative of the calendar month June.

When turned and rotated, as shown in FIG. 10, the tenth cube face 34, the eleventh cube face 35 and the twelfth cube face 36 of the second set of six cube faces 30 are exposed to view.

The tenth cube face 34 comprises four cube faces 82, 92, 102 and 112. Cube faces 82 and 112 are joined together with a double sized 119 pliable sheet material 120, forming a hinge portion 130 therebetween. Likewise, cube faces 92 and 102 are joined together with a double sized 119 pliable sheet material 120, forming a hinge portion 130 therebetween. The tenth cube face 34 shown in FIG. 9, preferably contains calendar indicia 122 representative of the calendar month August.

The eleventh cube face 35 comprises four cube faces 66, 76, 85 and 93. Cube faces 66 and 76 are joined together with a double pliable sheet material 119, forming a hinge portion 130 therebetween. Cube faces 85 and 93 are each covered with a single sized 118 pliable sheet material 120. The double sized 119 pliable sheet material 120 and two single sized 118 pliable sheet material 120 together form the eleventh cube face 35. The eleventh cube face 35 shown in FIG. 9, preferably contains calendar indicia 122 representative of the calendar month October.

The twelfth cube face 36 comprises four cube faces 53, 63, 96 and 104. Cube faces 53 and 104 are joined together with a double sized 119 pliable sheet material 120, forming a hinge portion 130 therebetween. Cube faces 63 and 96 are also joined together with double sized 119 pliable sheet material 120, forming a hinge portion 130 therebetween. The two double sized 119 pliable sheet materials 120 together form the twelfth cube face 36. The twelfth cube face 36 shown in FIG. 9, preferably contains calendar indicia 122 representative of the calendar month December.

The calendar indicia 122 is preferably alternated month by month between the first set of six cube faces 20 and the second set of six cube faces 30, so that the calendar cube apparatus 200 must be manipulated each month 132 by the user to present the next consecutive month 132.

Each hinged portion 130 is pivotable from an open linear position, to a closed parallel position wherein the respective cube sides are pivoted adjacent to eachother. Thus, the hinged portions 130 enable adjoining cube sides to be selectively manipulated to present any one of the twelve cube faces 38 for viewing upon the top portion of the calendar cube apparatus 10. The hinge portions 130 formed between the double sized 119 pliable sheet material 120, together provide selective manipulation of the eight cubes 38.

As best shown in FIG. 8, calendar indicia 122 representing a calendar month 132 is marked upon the exposed surface of each of the twelve cube faces 21–26 and 31–36. Each of the double sized 119 pliable sheet material 120 includes one-half of a selected calendar month, whereas calendar indicia representing one quarter of a calendar month is marked upon the exposed surface of each selected one of the single sized 118 pliable sheet material 120.

The calendar indicia 122 is arranged on each of the twelve cube faces 21 through 26 and 31 through 36, so that it appears to be oriented in a single direction when aligned into one of the twelve cube faces 21–26 and 31–36, for ease of reading. Thus, all twelve months 132 may be selectively positioned upon the top side 201 of the calendar cube apparatus 200, by selectively manipulating the eight individual cubes 38. The positioning and orientation of the double sized 119 pliable sheet material 120, which provides a hinge portion 130 therebetween, establishes which of the cube faces 21–26 and 31–36 may be pivoted about the hinged portion 130 in a given manipulation.

At least one of different colors, textures, or patterns may be used to highlight each of the twelve cube faces 21–26 and 31–36, to make selective orientation of each of the twelve cube faces easier to identify and selectively manipulate.

Preferably, advertising indicia 123 is also marked upon the exposed surface of at least some of the calendar month 132 cube faces 21–26 and 31–36. Thus, the calendar cube apparatus 200 useful as a sales, advertising, and/or promotional tool. While the advertising indicia 123 is shown at the bottom of the October calendar in FIG. 8, it is well within the ability of one of average skill in this art, to selectively position the advertising indicia 123 anywhere upon a selected cube face 21–26 and 31–36.

Preferably, the first set of six cube faces 20 comprise a first cube face 21 representing January, the second cube face 22 represents March, the third cube face 23 represents May, the fourth cube face 24 represents July, the fifth cube face 25 represents September and the sixth cube face 26 represents November.

In order to expose the second set of six cube faces 30, the eight individual cubes must be selectively manipulated as previously noted. The seventh cube face 31 represents February, the eighth cube face 32 represents April, the ninth cube face 33 represents June, the tenth cube face 34 represents August, the eleventh cube face 35 represents October, and the twelfth cube face 36 represents December.

In this way, the calendar cube apparatus 2000 must be manipulated each month between the first and second set of cube faces 20, 30, to position the current month upon the top face 201 of the calendar cube apparatus 200. This provides monthly entertainment for the user, and presents fresh sales, advertising and/or promotional material to the user during each month 132 of the year 134.

Of course other combinations of cube faces 21–26 and 31–36 may be used upon the first and second set of cube faces 20, 30, without departing from the scope of this disclosure, or the following claims.

The calendar cube apparatus 200 comprises eight equally sized, individual cubes 38. The size of each side of the eight cubes 38 are selected to be: from one-half inch to twelve inches, depending upon manufacturing preference. Each of the eight individual cubes 38 may be made as either a solid cube construction 136 or a hollow cube construction 137, depending upon manufacturing preference. Solid cube construction, preferably made of foam, is shown in FIG. 13. Hollow cube construction 137 is shown in FIG. 14 through FIG. 18. A single sheet material may be folded in a manner similar to that shown in FIG. 12, to form a hollow cube construction 137. Tabs 148 may also be used to secure adjoining cube sides 21–26 with adhesive 121, when a cube 38 is made of a single sheet material, such as paper or plastic, as shown in FIG. 12.

FIG. 14 through FIG. 18 show alternate ways to fabricate a hollow cube 137. In these embodiments, adjacent cube sides are secured together by any known means, such as gluing, thermal bonding, ultrasonic welding, ultraviolet bonding, etc.

A desk sized calendar cube apparatus 200 would preferably be selected to be in the range of one to six inches per cube portion, and would serve as a combination paperweight, conversation piece, puzzle, calendar and advertisement.

Other uses are also contemplated. One such use is a calendar cushion 150. In this embodiment, each of the eight equally sized cubes would be foam filled or stuffed with a suitable material, such as foam, beads, or inert filler, and covered in a suitable cloth or fabric with a selected calendar month indicia disposed upon each of the twelve cube faces 21–26 and 31–36. Advertising indicia 123 is also preferably placed upon one or more of the twelve cube faces 21–26 and 31–36. Each of the eight, individual cubes 38 have six equal cube sides per cube 38. The calendar cushion 150 would preferably be sized in the range of six to twelve inches square. Because four cubes sides are positioned to form a selected cube face 21–26 and 31–36, each of the first and second set of twelve cube faces 20, 30 are sized to be from twelve inches to twenty-four inches high, and usable as a seat or footrest, as well as a puzzle, calendar and advertisement. The orientation, use of hinge portions, and relationship of the eight equally sized cubes 38 would be the same as previously noted.

While several preferred embodiments of the calendar cube apparatus 10 have been shown and disclosed in the specification and drawings, it is well within the scope of one of average skill in this art to modify the orientation and positioning of the hinge portions 130 to achieve a variety of similar results, and such modifications and adaptations are intended to fall within the scope of the following claims.

Parts List

200—Calendar cube apparatus
201—top face
20—first set of six cube faces
21—first cube face
22—second cube face

23—third cube face
24—fourth cube face
25—fifth cube face
26—sixth cube face
30—second set of six cube faces
31—seventh cube face
32—eighth cube face
33—ninth cube face
34—tenth cube face
35—eleventh cube face
36—twelfth cube face
38—eight equally sized cubes
40—first cube
41—side 41
42—side 42
43—side 43
44—side 44
45—side 45
46—side 46
50—second cube
51—side 51
52—side 52
53—side 53
54—side 54
55—side 55
56—side 56
60—third cube
61—side 61
62—side 62
63—side 63
64—side 64
65—side 65
66—side 66
70—fourth cube
71—side 71
72—side 72
73—side 73
74—side 74
75—side 75
76—side 76
80—fifth cube
81—side 81
82—side 82
83—side 83
84—side 84
85—side 85
86—side 86
90—sixth cube
91—side 91
92—side 92
93—side 93
94—side 94
95—side 95
96—side 96
100—seventh cube
101—side 101
102—side 102
103—side 103
104—side 104
105—side 105
106—side 106
110—eighth cube
111—side 111
112—side 112
113—side 113
114—side 114
115—side 115
116—side 116
118—single cube sized pliable sheet
119—double cube sized pliable sheet
120—pliable material
121—adhesive
122—calendar indicia
123—advertising indicia
124—colored background
130—hinge portion
132—month
134—year
136—solid cube construction
137—hollow cube construction
138—individual cube sides
140—two-sided cube sides
142—three-sided cube sides
144—four-sided cube sides
146—five-sided cube sides
148—tabs
150—calendar cushion apparatus

We claim:

1. A calendar cube apparatus, which comprises:

a) eight individual cubes of equal size, each cube having six equally sized cube sides, with four selected cubes forming a cube face, comprising one of twelve selectively interchangeable cube faces;

b) a single sized pliable sheet material secured to an individual cube side, and a double sized pliable sheet material secured to selected adjacent cube sides, said double sized pliable sheet material secured to adjacent cube sides forming a hinged portion therebetween; said hinged portion selected to pivot between an open linear alignment and a parallel, adjacent closed alignment; and c) one of twelve monthly calendar indicia are selectively deposed upon each of the twelve cube faces, wherein manipulation of said eight cubes about said hinge portions, selectively exposes all twelve cube faces with respective twelve monthly calendar indicia into view upon a top face of the calendar cube apparatus.

2. The calendar cube apparatus of claim 1, wherein advertising indicia is included upon at least some of the twelve calendar cube faces.

3. The calendar cube apparatus of claim 1, wherein monthly calendar indicia for January, March, May, July, September and November are selectively positioned upon a first set of six cube faces, while monthly calendar indicia for February, April, June, August, October and December are selectively positioned upon a second set of six cube faces, requiring the user to manipulate the eight cubes between the first and second sets of cube faces each month, to selectively position a current calendar month upon a top face of the calendar cube apparatus.

4. The calendar cube apparatus of claim 1, wherein each of the eight equally sized cubes have six equal cube sides, and wherein each equal cube side is selected to be from one-half inch to twelve inches across.

5. The calendar cube apparatus of claim 1, wherein the single and double sized pliable sheet material is selected to be at least one of: paper, plastic, cloth and fabric.

6. The calendar cube apparatus of claim 1, wherein each of the eight calendar cubes are selected to be one of: solid and hollow construction.

7. The calendar cube apparatus of claim 1, wherein the cubes are selectively manipulated at least three times to interchange the first set of six cube faces and the second set of six cube faces.

8. The calendar cube apparatus of claim 1, wherein the eight individual cubes are each made from at least one of: plastic, foam, wood, paper, cork, inert filler and fabric.

9. The calendar cube apparatus of claim 1, wherein at least one of distinct colors, textures and patterns are used on each of the twelve cube faces, to aid in identification and selective manipulation of the eight cubes.

10. A calendar cube apparatus, which comprises:

a) eight individual cubes, each cube having six equal cube sides, with four selected cube sides forming a square cube face, said cube face being one of a first set of six cube faces and a second set of six cube faces, together forming twelve selectively interchangeable cube faces;

b) a single sized pliable sheet material is secured to selected single cube sides and a double sized pliable sheet material is secured to selected adjacent cube sides, said double sized pliable sheet material secured to adjacent cube sides forming a hinged portion therebetween; said hinged portion positioned to pivot between an open linear alignment and a side-by-side closed alignment; and c) a selected one of twelve monthly calendar indicia are selectively deposed upon each of the twelve cube faces; and d) advertising indicia is also placed upon ach of the twelve cube faces, wherein manipulation of said eight cubes about said hinge portions, selectively exposes all twelve cube faces, to bring a selected monthly calendar indicia and advertising indicia into view upon a top face of the calendar cube apparatus.

11. The calendar cube apparatus of claim 10, wherein calendar indicia for January, March, May, July, September and November are selectively positioned upon the first set of six cube faces, while calendar indicia for February, April, June, August, October and December are selectively positioned upon the second set of six cube faces, requiring the user to selectively manipulate the eight cubes to position a current month upon a top face of the calendar cube.

12. The calendar cube apparatus of claim 10, wherein the single and double sized pliable sheet material is selected to be at least one of: paper, plastic, cloth and fabric.

13. The calendar cube apparatus of claim 10, wherein selected ones of the eight cubes are selectively manipulated at least three times to interchange the first set of six cube faces and the second set of six cube faces.

14. The calendar cube apparatus of claim 10, wherein the eight individual cubes are each made from at least one of: plastic, foam, wood, paper, cork, inert filler and fabric, and wherein the eight cubes are further selected to be one of: solid and hollow construction.

15. The calendar cube apparatus of claim 10, wherein at least one of distinct colors, textures and patterns are used on each of the six faces of the eight cubes, to aid in identification and selective manipulation of the eight cubes.

16. The calendar cube apparatus of claim 10, wherein different colors are used as background on each of the twelve cube faces.

17. A calendar cube apparatus, which comprises:

a) eight individual cubes, each cube having six equally sized cube sides, with four selected cubes forming one of twelve selectively interchangeable cube faces;

b) a first pliable sheet material is secured to each single sized cube side and a double sized pliable sheet material is secured to selective adjacent cube sides, said double sized pliable sheet material secured to adjacent cube sides to form a hinged portion therebetween; said hinged portion selected to pivot between an open linear alignment and a side-by-side closed alignment; and c) one of twelve monthly calendar indicia are selectively disposed upon each of the twelve cube faces, wherein manipulation of said eight cubes about said hinge portions selectively exposes all twelve cube faces to view;

d) advertising indicia is disposed upon each of the twelve cube faces together with each of the twelve monthly calendar indicia; and e) calendar indicia for January, March, May, July, September and November are selectively positioned upon a first set of six cube faces, while February, April, June, August, October and December are selectively positioned upon a second set of six cube faces, requiring the user to manipulate the eight cubes to position a current month upon a top face of the calendar cube apparatus.

18. The calendar cube apparatus of claim 17, wherein the single and double sized pliable sheet material is selected to be at least one of: paper, plastic, fabric and cloth, and the pliable sheet material is secured to adjacent cube sides with adhesive.

19. The calendar cube apparatus of claim 17, wherein the eight cubes are selected to be one of: solid and hollow construction, and the eight cube portions are made from at least one of: plastic, foam, wood, paper, cork, and inert filler material.

20. The calendar cube apparatus of claim 17, wherein at least one of distinct colors, textures and patterns are used on each of the six cube faces, to aid in identification and selective manipulation of the eight cubes.

21. The calendar cube apparatus of claim 17, wherein the eight cubes are selectively manipulated at least three times to interchange the first set of six cube faces with the second set of six cube faces.

* * * * *